United States Patent [19]

Fikkers

[11] 4,428,457

[45] Jan. 31, 1984

[54] WINDOW BRACKET SUPPORT AND SCAFFOLDING FOR BUILDING EXTERIOR

[76] Inventor: John T. Fikkers, 805 Rosita Rd., Pacifica, Calif. 94044

[21] Appl. No.: 423,011

[22] Filed: Sep. 24, 1982

[51] Int. Cl.[3] ..... E04G 3/06

[52] U.S. Cl. ..... 182/55; 182/60; 182/150

[58] Field of Search ..... 182/53, 54, 55, 56, 182/57, 58, 59, 60, 61, 62, 82, 150, 113; 248/236, 208

[56] References Cited

U.S. PATENT DOCUMENTS

| | | | |
|---|---|---|---|
| 266,691 | 10/1882 | Heimsath | 182/60 |
| 920,452 | 5/1909 | Gilkeson | 182/55 |
| 959,278 | 5/1910 | Wells | 182/54 |
| 1,086,348 | 2/1914 | Bolognesi | 182/53 |
| 1,165,435 | 12/1915 | Mishel | 182/60 |
| 1,456,362 | 5/1923 | Cresson | 182/60 |
| 1,458,744 | 6/1923 | Brewster | 182/58 |
| 1,511,260 | 10/1924 | Brousseau | 182/60 |
| 1,621,626 | 3/1927 | Chieffo | 182/56 |
| 2,562,619 | 7/1951 | Kolodziej | 182/60 |
| 4,320,816 | 3/1982 | Callahan | 182/55 |

FOREIGN PATENT DOCUMENTS

| | | | |
|---|---|---|---|
| 414126 | 12/1966 | Switzerland | 182/55 |

*Primary Examiner*—Reinaldo P. Machado
*Attorney, Agent, or Firm*—Alfons Puishes

[57] ABSTRACT

A window bracket is constructed to be supported on a window sill and the walls beneath the sill of an open window and further constructed to hold a safety scaffold to permit work on the exterior of the building, either on the windows or the area between windows. It may be used in pairs to hold a scaffold or in greater numbers where the scaffold is longer and extends over a greater area of the building exterior. It is rigidly constructed by welding of steel or aluminum alloy for rapid installation through open windows and is equipped with safety railings and reinforcing brackets to insure complete safety of workmen working on the outside of the building, such as repairing the exterior wall, painting or washing or repairing the windows from the exterior of the building.

4 Claims, 4 Drawing Figures

WINDOW BRACKET SUPPORT AND SCAFFOLDING FOR BUILDING EXTERIOR

STATE OF THE ART

Numerous devices have been constructed for fastening on to a window sill to give access to the outside of the window for cleaning, etc. Some of these have distinct advantages, but many are not completely safe for use and have other disadvantages and limitations as set forth below.

The prior art as known to the applicant at this time is set forth with comments as follows:

U.S. Pat. No. 266,691 to Heimsath discloses triangular frames and adjustable brackets which clamp on to a wall under a window. They comprise basically adjustable A-shaped side frames and provide for a fire escape for which the device is primarily adapted. It provides no scaffolding facilities for work on the exterior of the building.

U.S. Pat. No. 920,452 to Gilkeson, basically comprises a pair of hook-shaped straps with adjustable brackets attached thereto. The brackets support a floor by-U bolts from the bracket frame. It is not positively clamped to the wall of the building and hence does not appear to provide adequate safety.

U.S. Pat. No. 1,165,435 to Mishel utilizes a single clamp and bracket on the window sill. The exterior platform is supported on beams having inward and outward adjustment. It is adapted primarily for window cleaning and not for any heavy exterior work on the building.

U.S. Pat. No. 1,456,362 to Cresson discloses window sill brackets to clamp against inside and outside of a projecting platform support braced against the building wall with adjusting knee bracket. It does not appear to afford one hundred percent safety to a person on the platform.

U.S. Pat. No. 1,511,260 to Brousseau discloses a platform support with C-shaped end projections attached to the inside wall. It is made collapsible for rapid assembly and dis-assembly. This likewise does not appear to afford complete safety to a person using it, like the previous devices which are both primarily built for the purpose of window washing.

U.S. Pat. No. 1,621,626 to Chieffo discloses a platform which is hung from the sides of a window frame from permanently installed attachments to the window frame. It provides for lateral adjustment of a slatted platform with fire escape means. It requires permanent installation of hooks on the windows for its support.

U.S. Pat. No. 2,562,619 to Kolodziej utilizes U-shaped platform support with V-shaped ends or frames. One end of the V-frame rests on the outside of the window sill. The frame is attached to the sill inside by U-shaped clamps on an inside edge of a sill. It requires a special window construction for its use.

U.S. Pat. No. 4,320,816 to Callahan, et al covers a folding or collapsible perch constructed from pipe and fitting members adapted for passing through an open window frame and held in place outside the window by C-clamps attached to walls under the window. Its principal features is its collapsibility when not in use.

It will be noted that all of the prior art is confined to access to the outside of a single window and is definitely so limited. None of the prior art teaches any device for access to the outside of the building in order to reach several windows or the building wall between windows.

SUMMARY OF THE INVENTION

My invention relates to a scaffolding combination which comprises a novel bracket which may be extended through an open window and fastened upon the sill and the wall of the building below the sill. My invention further comprises a rigid structure which when secured to the building wall over a window sill is constructed to support scaffolding outside the building, including safety protective rails for workmen standing on the scaffold planks, which my structure is constructed to support.

The use of my special brackets is not confined to a single window opening, which is the case with all of the prior art, but the brackets may be secured to a building through several adjacent window openings and thus provide scaffold support for an area of the building comprising two or more window openings as may be desired.

I also provide a ladder suspension which may be used for fire escape purposes but also to gain access to similar brackets and scaffolding combinations on the building at lower elevations. My device therefore permits scaffolding covering the entire exterior of a building without building up from the ground to permit access and work upon a larger area of the exterior of the building with a minimum amount of effort.

DESCRIPTION OF A PREFERRED EMBODIMENT

Figure 2:
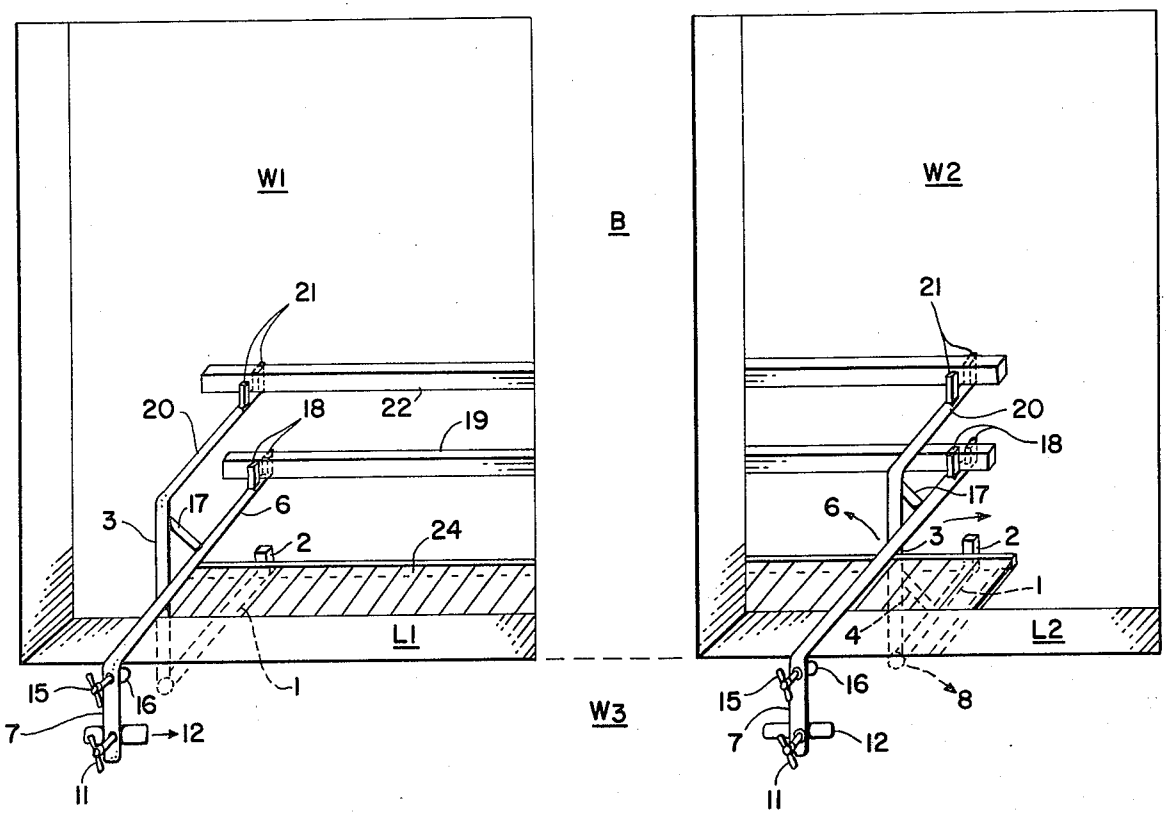
FIG. 2 is a view of my completed scaffold as seen from the inside of the building through the windows.

For a better understanding of my invention, reference may first be had to FIG. 2 in which $W_1$ and $W_2$ represent two adjacent windows in a building. B represents the building wall space between two windows. $L_1$ and $L_2$ represent the sills below window $W_1$ and window $W_2$ respectively. $W_3$ represents the wall beneath the window sills $L_1$ and $L_2$.

Figure 1:
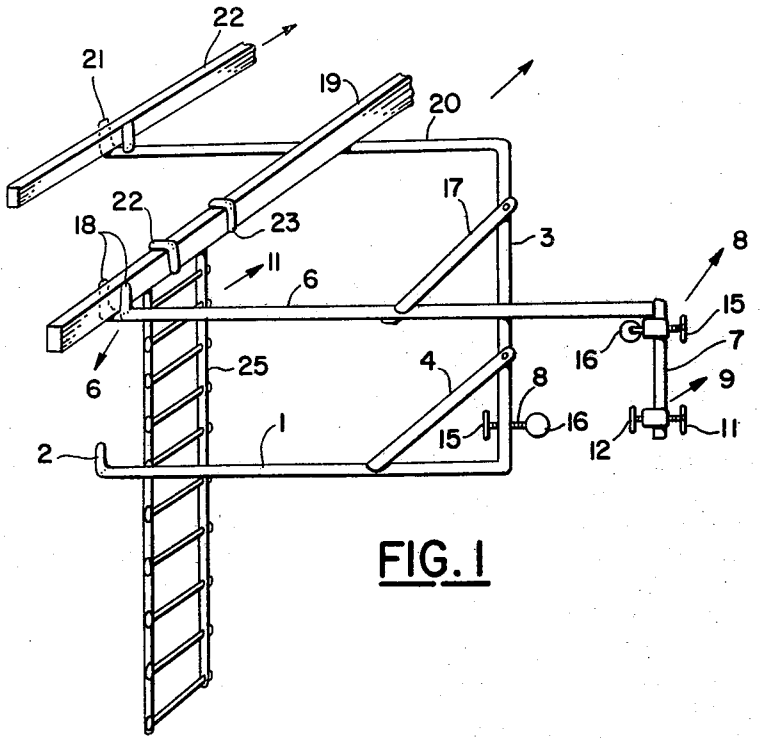
FIG. 1 is a perspective view of one of the structural combinations comprising a single scaffold support or bracket.

With reference now to FIG. 1, the orientation of my structural bracket may be better understood by reference to $L_1$ and $L_2$ the sills of the windows $W_1$ and $W_2$ respectively and $W_3$ which is the wall of the building underneath the window sills $L_1$ and $L_2$.

The structural members of my bracket about to be described may be ¾ inch by 2 inch flat iron, or aluminum alloy members of similar size.

First, we have horizontal beam 1 positioned extending from the outside of wall $W_3$ and having at its end a safety stop 2 disposed to hold scaffold planks 24 from sliding off of the bracket. This stop may be approximately 6 inches in height.

All of the structural members to be described following are welded together to form a rigid structure. At a point adjacent Wall $W_3$ vertical member 3 is welded to the aforementioned horizontal beam 1. A knee bracket 4 is diagonally welded between vertical member 3 and horizontal member 1 for strength and stiffness.

A second horizontal beam member 6 which is adapted for positioning upon the sills $L_1$ and $L_2$ is welded to vertical member 3 and knee bracket 17 which latter is likewise welded to the upper section of vertical member 3.

A vertical clamping member 7 is welded to the end of beam 6 and adapted for positioning against wall $W_3$.

Figure 3:
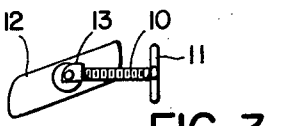
FIG. 3 is a perspective of the lower clamp and handle 11 holding the bracket to the wall.
Figure 4:
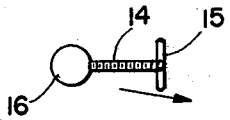
FIG. 4 is a perspective of the upper clamp and inside lower clamp and handle 15 holding the bracket to the wall.

Member 7 provides for clamping to wall 3 by means of screw clamps identified by their handles as 11 and 15 best seen on FIG. 2 and FIG. 4, which operate respectively through threaded nuts 8 and 9 attached to member 7. Lower screw member 10, forming a part of tightening clamp 11 is equipped with contact plate 12 and pivot 13 which permits tight fastening to the wall $W_3$. Upper threaded screw 14 on handle 15 engages nut 8, has affixed upon it handle 15 and pivoted knob 16 disposed also to bear against the outside of wall $W_3$. An identical clamp assembly is positioned on the lower end of member 3 and disposed to engage the inside of wall $W_3$ as seen on FIG. 1.

Knee bracket 17, which is welded to beam 6 and vertical member 3, previously described, serves to reinforce beam 6 at the end of which are positioned two short vertical stops 18 to hold in position a 2" by 4" timber railing 19.

A third horizontal beam 20 is welded to the top of vertical member 3 and supports on its outer end a pair of short vertical stops 21 which hold in position a 2" by 4" rail 22. Two by four rail 19 is equipped with hooks 23 to hold rope ladder 25. While this rope ladder is suitable for fire escape purposes, in view of the general wide application of this scaffold covering the outside of a building, it may be employed for access from one story to another of the scaffolding as it is applied to a given building exterior at several elevations.

Scaffolding plans 24, previously mentioned, are best seen on FIG. 2 where they are supported by horizontal member 1 and controlled by stops 2.

Where several of my brackets are used in adjacent windows, these planks may be extended, or other planks used in conjunction with these, to increase the effective width of the scaffolding which also applies in general to the safety rails 19 and 22.

The superiority of my invention, particularly in view of the flexibility and portability of the brackets and the inherent safety features built in to my construction is readily evident from the foregoing.

I claim:

1. A window bracket support for a scaffold supported from a building window sill and the adjacent building wall comprising:

a first vertical member positioned against the exterior of said wall and extending on both sides of said sill;

a second parallel vertical member adjacent the interior of said wall extending beneath said sill;

means for clamping said vertical members to said wall;

a first horizontal member positioned at the lower end of said first vertical member at right angles thereto and welded thereto and projecting beyond the exterior wall of said building;

a second horizontal member positioned upon said sill at right angles to said vertical members and welded thereto;

a third horizontal member positioned at the upper end of said first vertical member and welded thereto;

a first knee brace welded to said first horizontal member and the lower section of said first vertical member;

a second knee brace welded to said second horizontal member and the upper section of said first vertical member;

a short vertical member welded to the outer end of said first horizontal member;

a pair of short parallel vertical members welded to the outer end of said second horizontal member defining a slot therebetween and disposed to hold one end of a first railing therein, perpendicular to said second horizontal member;

a pair of short parallel vertical members welded to the outer end of said third horizontal member defining a slot therebetween and disposed to hold one end of a railing therein perpendicular to said third horizontal member;

said first horizontal member being disposed to hold one end of a horizontal support platform.

2. The bracket of claim 1 including a second identical bracket positioned in parallel to said bracket of claim 1 on a second window sill adjacent said first window and including a first horizontal rail positioned in said slot in said second horizontal member and perpendicular thereto and a second rail positioned in said slot in said third horizontal member and perpendicular thereto;

said rail disposed to span the space between said brackets;

a platform member positioned upon said first horizontal member and spanning the space between said brackets;

thereby defining a scaffold on the exterior of said building.

3. The bracket of claim 1 including a plurality of identical brackets positioned in parallel upon adjacent windows and defining supports for an extended scaffold on the outside of said building wall.

4. The bracket of claim 2 including a pair of hooks positioned on said first horizontal rail;

a rope ladder suspended from said hooks of sufficient length to reach a lower floor of said building.

* * * * *